US012222145B2

(12) United States Patent
Lee et al.

(10) Patent No.: US 12,222,145 B2
(45) Date of Patent: Feb. 11, 2025

(54) REFRIGERATOR WITH REFRIGERANT RECOVERY CONTROL

(71) Applicant: LG ELECTRONICS INC., Seoul (KR)

(72) Inventors: Sangil Lee, Seoul (KR); Jinseok Hu, Seoul (KR); Buhwan Ahn, Seoul (KR); Seonggu Shin, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 90 days.

(21) Appl. No.: 18/020,214

(22) PCT Filed: Jun. 17, 2021

(86) PCT No.: PCT/KR2021/007626
§ 371 (c)(1),
(2) Date: Feb. 7, 2023

(87) PCT Pub. No.: WO2022/039362
PCT Pub. Date: Feb. 24, 2022

(65) Prior Publication Data

US 2023/0349609 A1 Nov. 2, 2023

(30) Foreign Application Priority Data

Aug. 19, 2020 (KR) ..... 10-2020-0103837

(51) Int. Cl.

| | |
|---|---|
| ***F25D 11/02*** | (2006.01) |
| ***F25B 41/20*** | (2021.01) |
| ***F25B 45/00*** | (2006.01) |
| ***F25B 49/02*** | (2006.01) |

(52) U.S. Cl.
CPC ..... *F25B 49/02* (2013.01); *F25B 41/20* (2021.01); *F25B 45/00* (2013.01); *F25D 11/022* (2013.01); *F25B 2400/19* (2013.01); *F25B 2500/19* (2013.01); *F25B 2600/024* (2013.01); *F25B 2600/2515* (2013.01); *F25B 2700/151* (2013.01)

(58) Field of Classification Search
CPC ..... F25B 41/20; F25B 49/02; F25B 2400/19; F25B 2500/19; F25B 2600/24; F25B 2600/2515; F25B 2700/151; F25D 11/022
See application file for complete search history.

(56) References Cited

U.S. PATENT DOCUMENTS

2006/0048530 A1 3/2006 Jun et al.

FOREIGN PATENT DOCUMENTS

| | | |
|---|---|---|
| EP | 1106943 | 6/2001 |
| JP | H10220899 | 8/1998 |
| JP | 2019138513 | 8/2019 |
| KR | 20040055240 | 6/2004 |
| KR | 100826179 | 4/2008 |
| KR | 100846114 | 7/2008 |
| KR | 20080103854 | 11/2008 |
| KR | 20120085403 | 8/2012 |

OTHER PUBLICATIONS

Extended European Search Report in European Appln. No. 21858450.6, mailed on Feb. 26, 2024, 10 pages.

*Primary Examiner* — Jonathan Bradford
(74) *Attorney, Agent, or Firm* — Fish & Richardson P.C.

(57) ABSTRACT

A method controls a refrigerator. The refrigerator includes a compressor that includes a piston and uses refrigerant as lubricant for the piston, and the method includes determining an end time point of a refrigerant recovery operation based on a driving input value of the compressor to thereby reducer abrasion of the piston and power consumption.

20 Claims, 13 Drawing Sheets

【FIG 1】
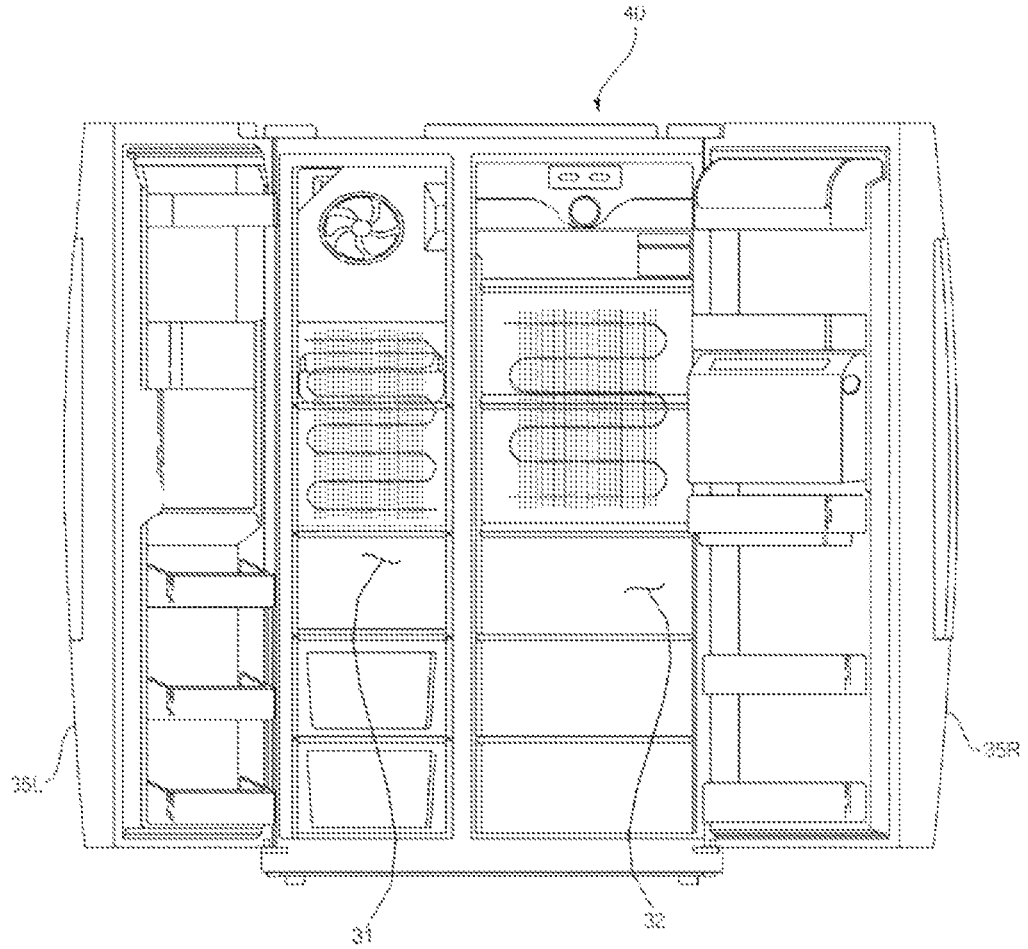

【FIG 2】
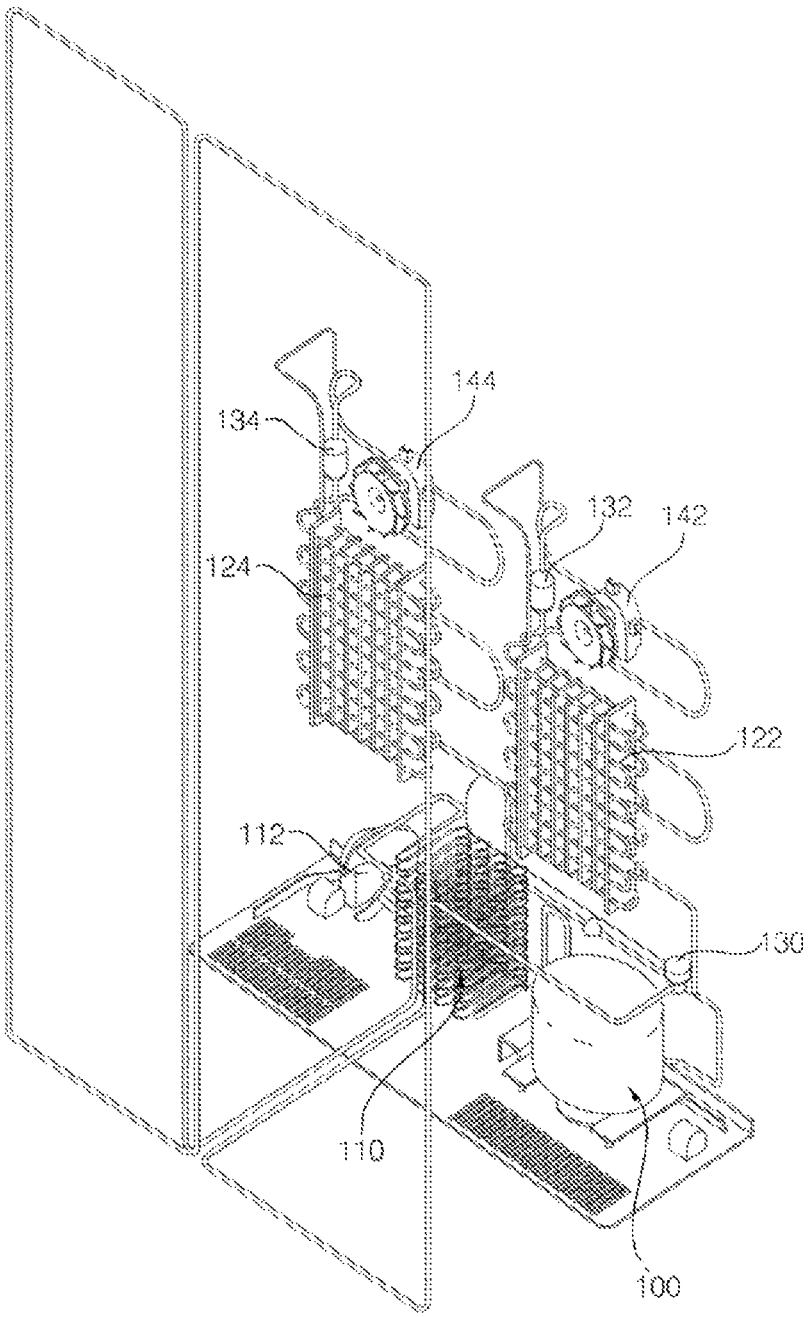

【FIG 3】
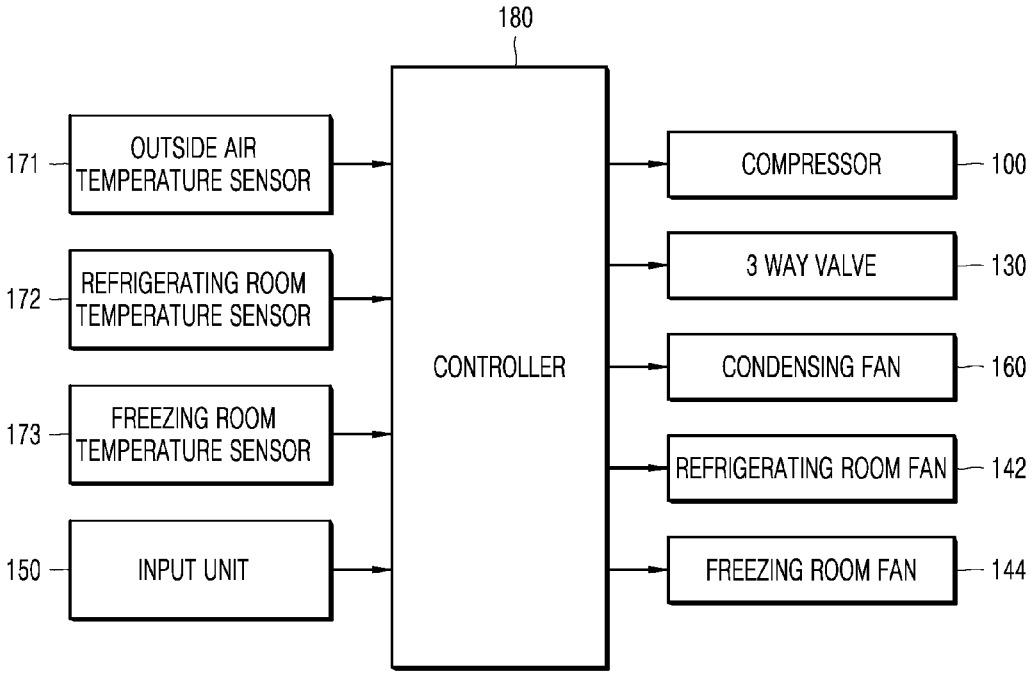

[FIG 4]
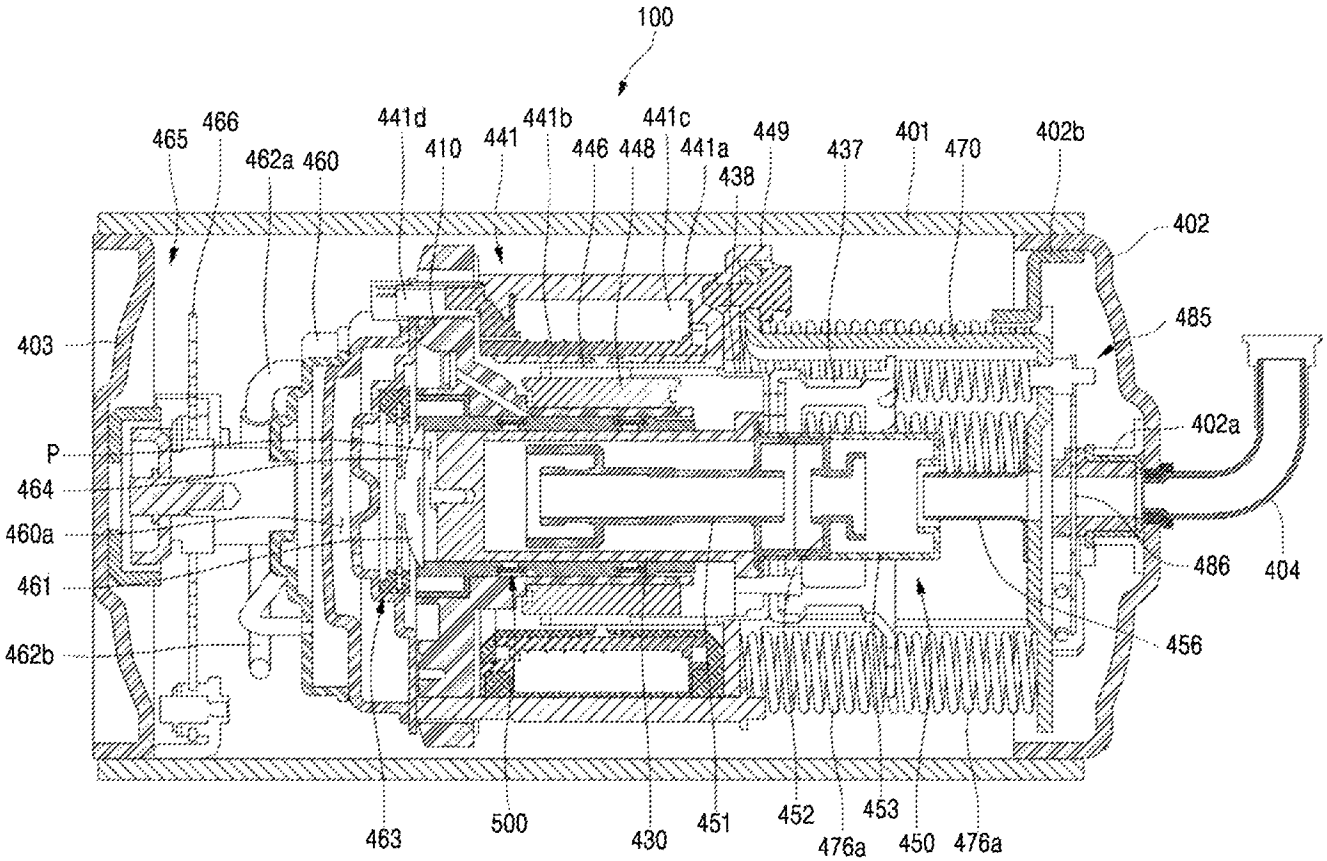

【FIG 5】
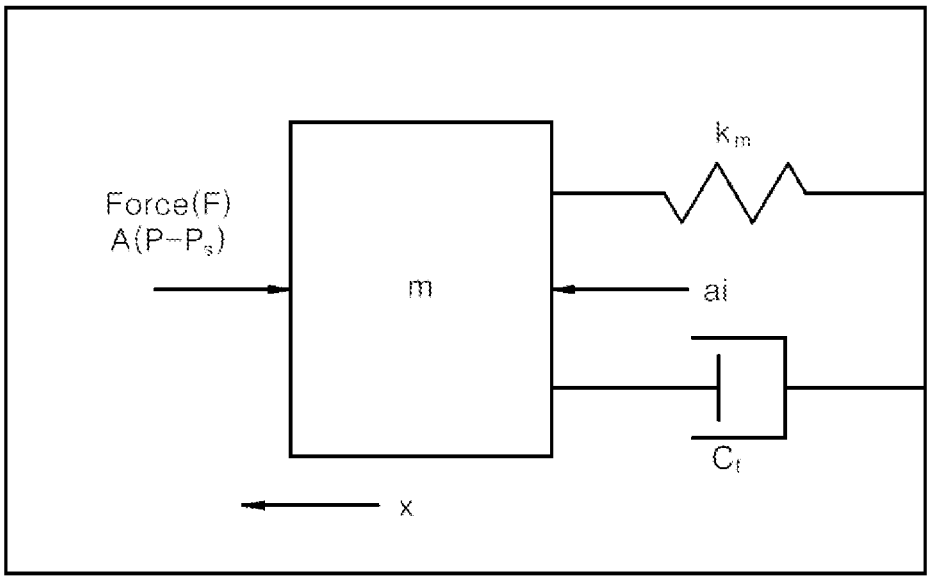
【FIG 6】
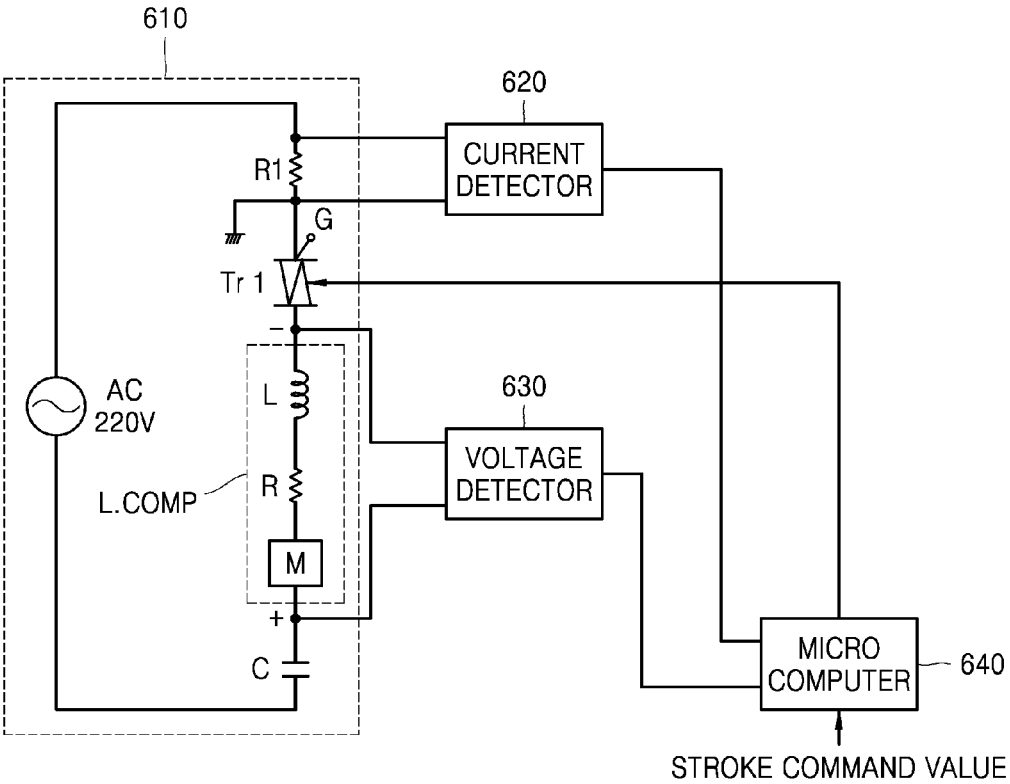

[FIG 7]
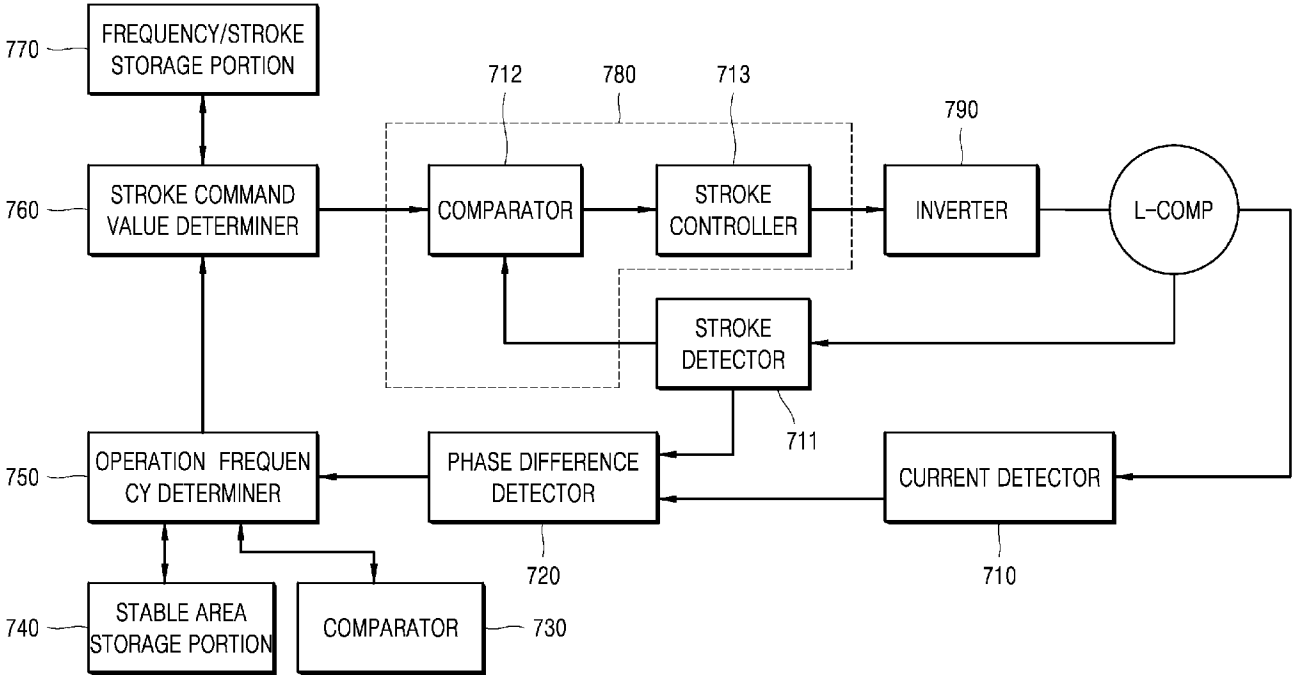

【FIG 8】
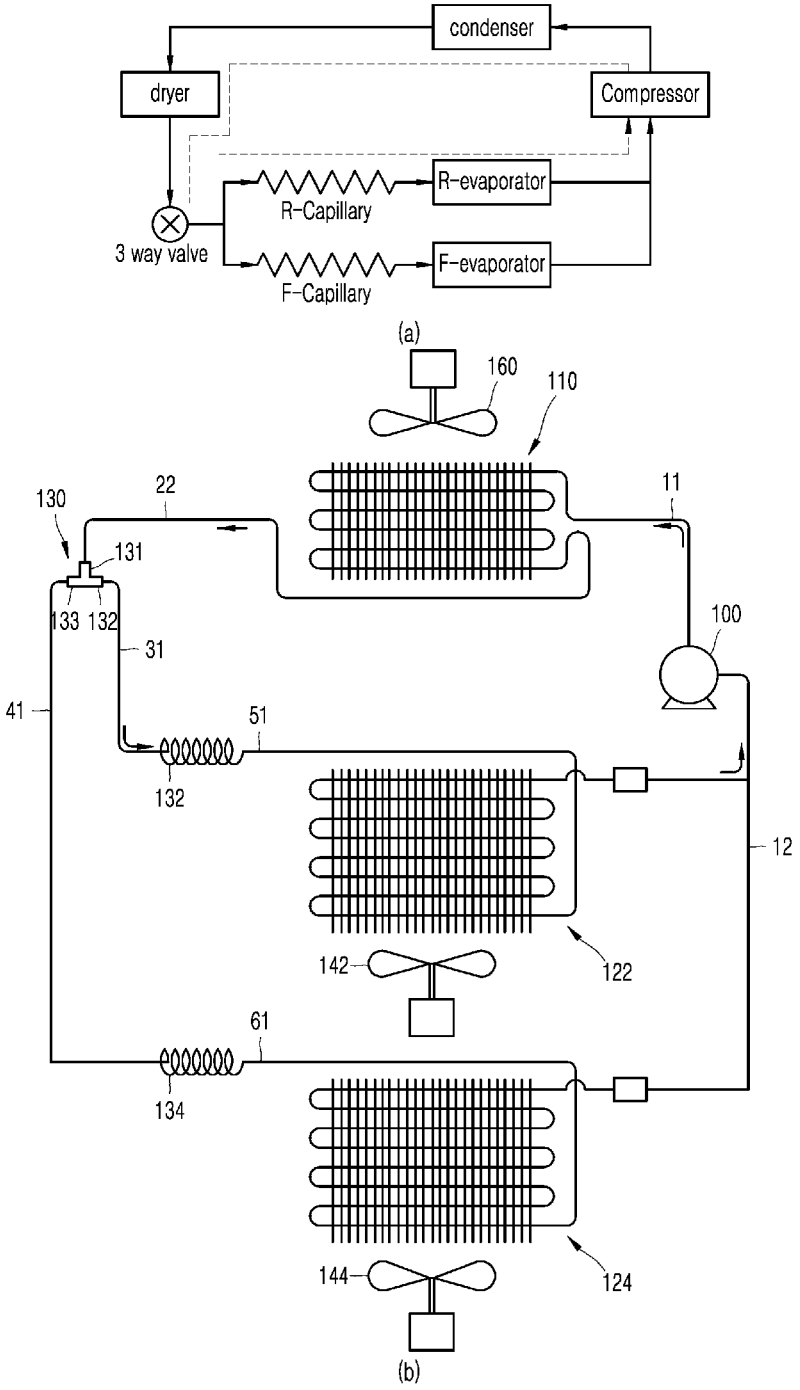

【FIG 9】
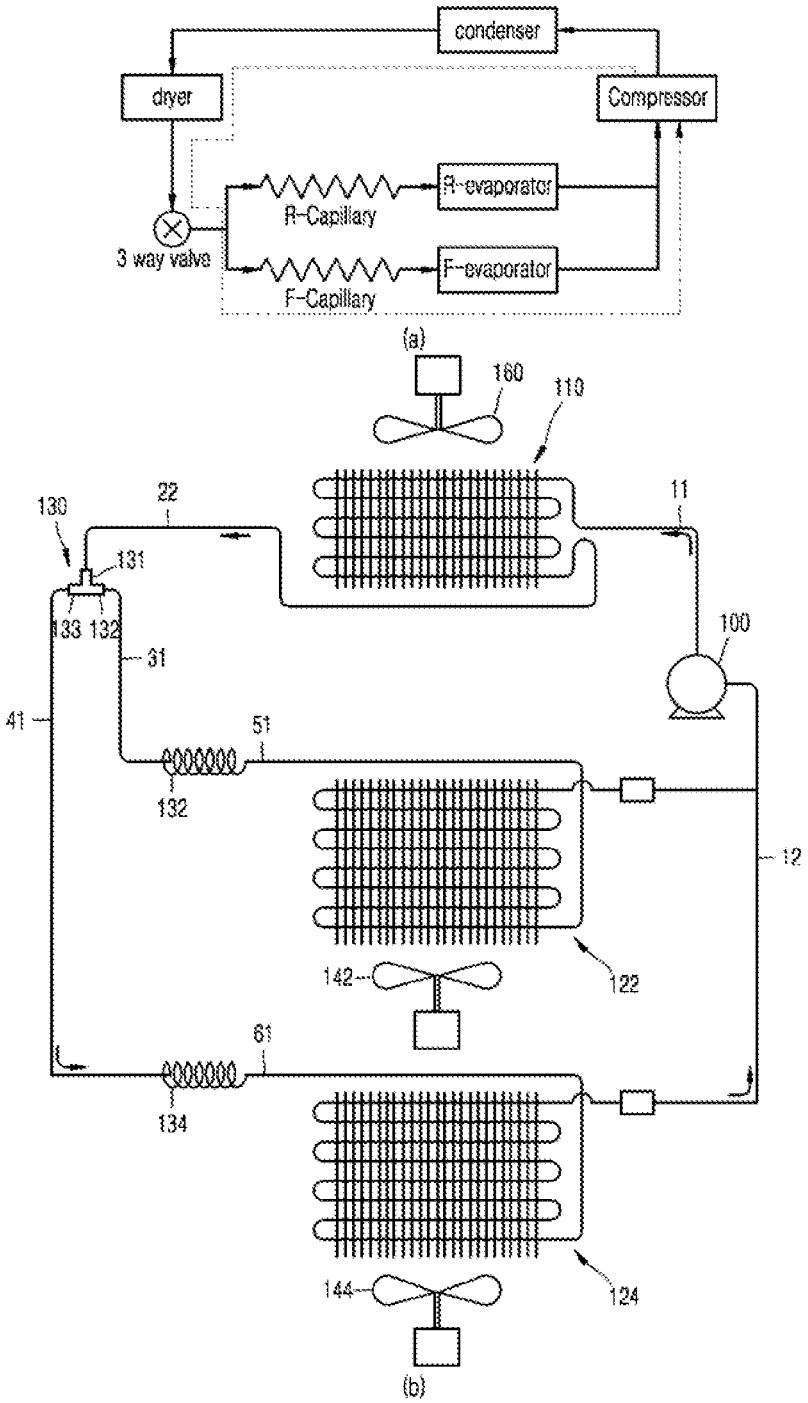

【FIG 10】
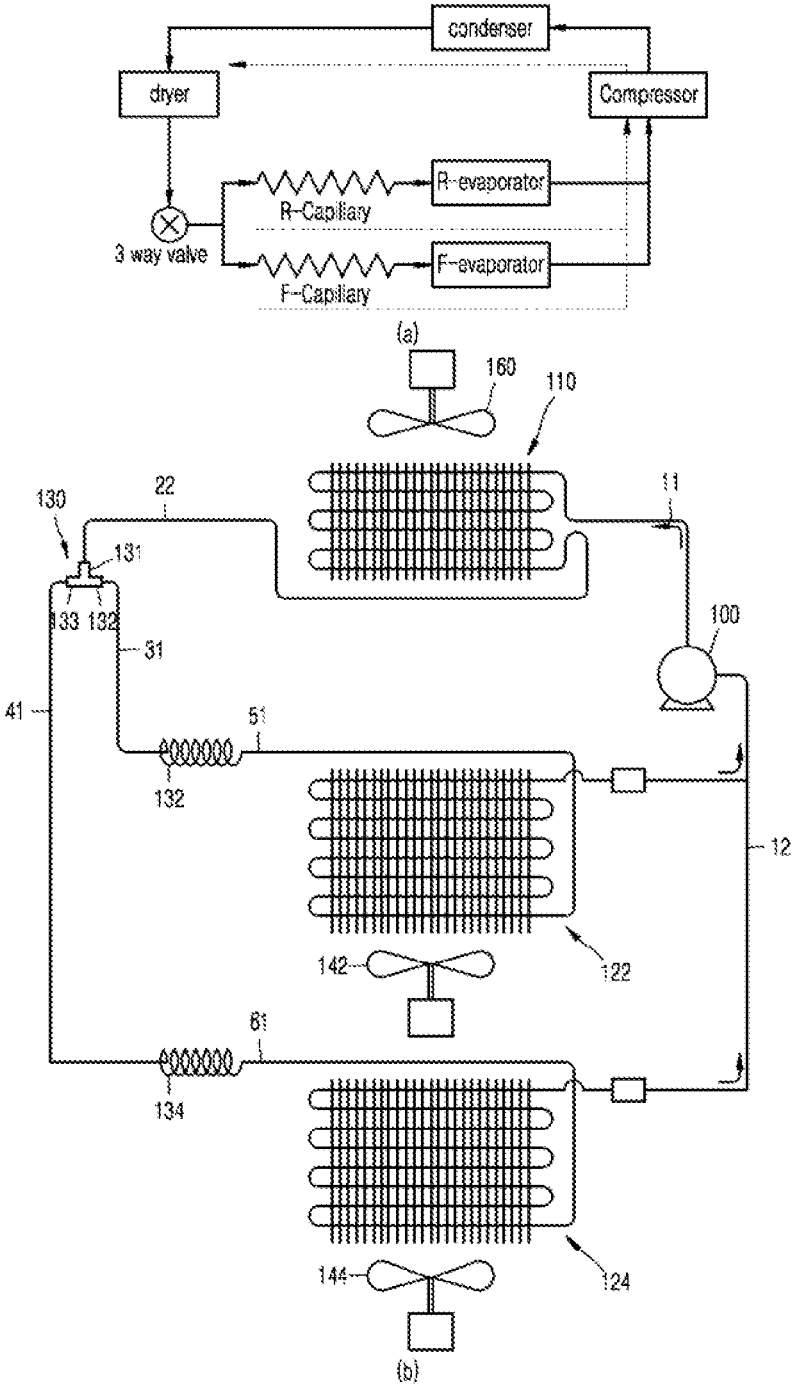

【FIG 11】
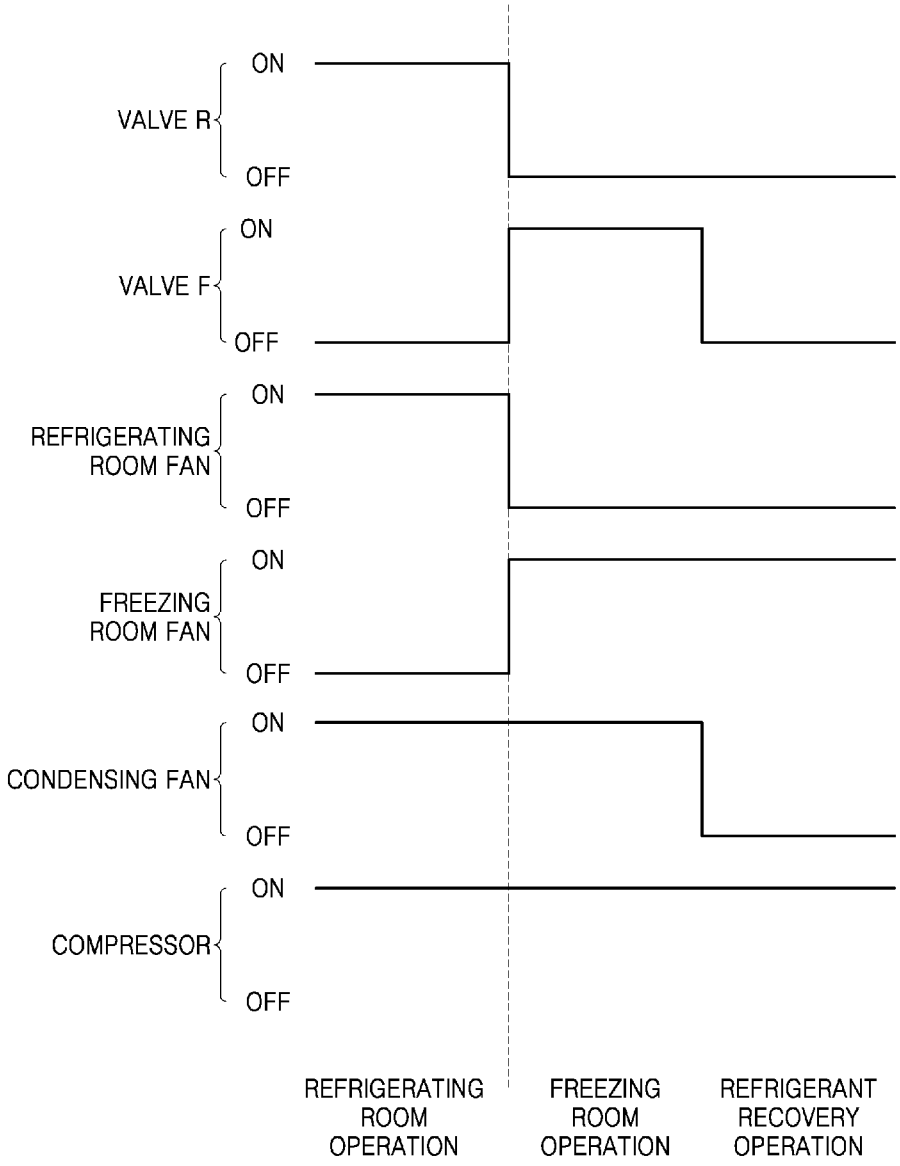

【FIG 12】
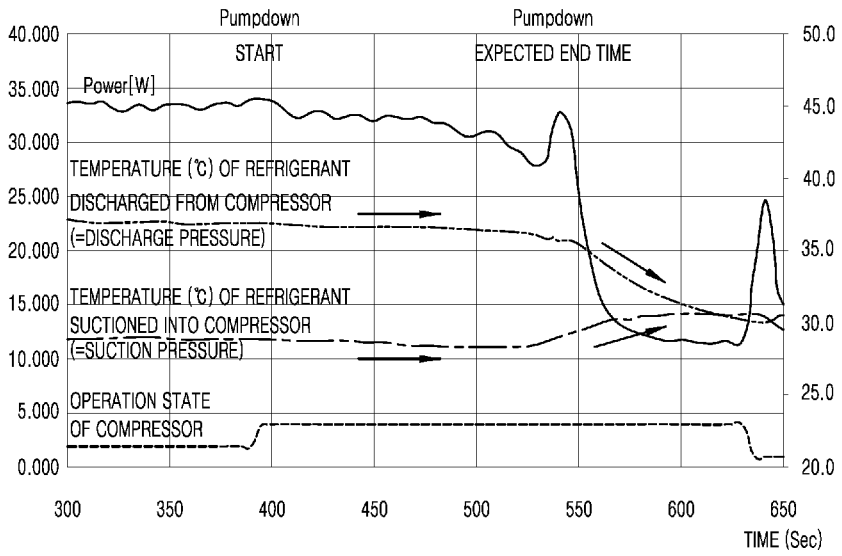
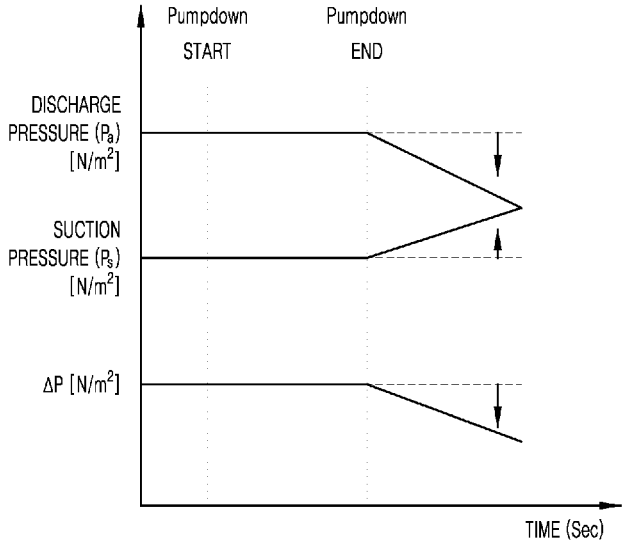

【FIG 14】

| No | DATA | DESCRIPTION |
|---|---|---|
| 1 | power | INPUT VALUE (POWER VALUE) OF COMPRESSOR [W] |
| 2 | phase | PHASE DIFFERENCE BETWEEN PISTON STROKE AND DRIVING CURRENT |
| 3 | current | CURRENT VALUE [A] |
| 4 | PWM | VOLTAGE PWN OUTPUT |
| 5 | Kgas | SPRING CONSTANT VALUE DETERMIEND BASED ON FORCE OF REFRIGERANT GAS IN CYLINDER [N/m] |
| 6 | Cgas | ATTENUATION CONSTANT VALUE DETERMINED BASED ON FORCE OF REFRIGERANT GAS INSIDE CYLINDER [Ns/m] |

REFRIGERATOR WITH REFRIGERANT RECOVERY CONTROL

CROSS-REFERENCE TO RELATED APPLICATION

This application is a National Stage application under 35 U.S.C. § 371 of International Application No. PCT/KR2021/007626, filed on Jun. 17, 2021, which claims priority from Korean Patent Application No. 10-2020-0103837 filed on Aug. 19, 2020, in the Korean Intellectual Property Office, and all the benefits accruing therefrom under 35 U.S.C. 119, the contents of which in their entirety are herein incorporated by reference.

TECHNICAL FIELD

The present disclosure relates to a refrigerator performing a refrigerant recovery operation to recover refrigerant, that is, a pump down operation, and a control method thereof.

BACKGROUND ART

A refrigerator is an apparatus to prevent spoilage and deterioration by cooling objects to be cooled (hereinafter; referred to as "food") such as food, drugs, and cosmetics. The refrigerator includes a storage portion in which food is stored and a cooling device to cool the storage portion.

The cooling device may include a compressor, a condenser, a refrigerant control valve, an expansion valve (e.g., a capillary pipe), and an evaporator through which the refrigerant is circulated.

The refrigerator may include a 1COMP-1EVA system to cool both a freezing room (an F-room) and a refrigerating room (an R-room) using a compressor and an evaporator and may include a 1COMP-2EVA system to independently cool the freezing room and the refrigerating room using a compressor and two evaporators. In this case, the two evaporators include a freezing room evaporator to cool the freezing room and a refrigerating room evaporator to cool the refrigerating room.

The refrigerator including the 1COMP-2EVA system to independently cool the freezing room and the refrigerating room connects the freezing room evaporator and the refrigerating room evaporator in parallel and independently cools the freezing room and the refrigerating room.

The refrigerator including the 1COMP-2EVA system in related art repeats refrigerating room operation, freezing room operation, and refrigerant recovery operation and independently cools the refrigerating room and the freezing room.

The refrigerating room operation is an operation in which the refrigerant passes through the refrigerating room evaporator and the refrigerating room evaporator cools the refrigerating room. The freezing room operation is an operation in which the refrigerant passes through the freezing room evaporator and the freezing room evaporator cools the freezing room. The refrigerant recovery operation, that is, the pump down operation, is an operation in which refrigerant control valve (i.e., a 3 way valve) is adjusted to block flow of the refrigerant to each of the refrigerating room evaporator and the freezing room evaporator while a compressor is operated, and the refrigerant remaining in the refrigerating room evaporator and the refrigerant remaining in the freezing room evaporator are recovered to the compressor. The refrigerant recovery operation is performed between the freezing room operation and the refrigerating room operation. When the refrigerant recovery operation is performed between the freezing room operation and the refrigerating room operation, the refrigerant from the freezing room evaporator having relatively lower pressure and temperature than those of the refrigerating room evaporator is recovered to the condenser, is supplied to the refrigerating room evaporator during the operation of the refrigerating room, the refrigerant from the condenser quickly flows to the refrigerating room evaporator. When the refrigerating room is operated, sufficient amount of refrigerant flows to the refrigerating room evaporator to quickly cool the refrigerating room.

Meanwhile, Korean Patent Publication No. 10-2007-031656 discloses a method for controlling a refrigerator comprising, when refrigerant is recovered from a refrigerating room evaporator or a freezing room evaporator, smoothly recovering the refrigerant remaining in the refrigerating room evaporator or the freezing room evaporator by driving a refrigerating room fan or a freezing room fan.

In the above-described related art patent, the refrigerator performs the refrigerant recovery operation for a fixed period of time. However, when the refrigerator performs the refrigerant recovery operation for the fixed period of time, there is a problem in that a performance of the refrigerant recovery operation varies depending on the operation conditions of the refrigerator.

That is, the performance of the refrigerant recovery operation varies depending on a power of the compressor. When the refrigerant recovery operation is performed for the fixed period of time, the refrigerant is not recovered properly when a cooling power is low and an excessive amount of power is supplied when the cooling power is high. Therefore, in the above-described related art patent, the refrigerant recovery operation may not be efficiently performed.

DISCLOSURE

Technical Problem

The present disclosure provides a refrigerator and a control method thereof capable of accurately determining an end time point of a refrigerant recovery operation.

The present disclosure also provides a refrigerator and a control method thereof capable of setting an end time point of the optimal refrigerant recovery operation to prevent abrasion of a piston occurring when refrigerant gas is used as a lubricant.

The present disclosure further provides a refrigerator and a control method thereof capable of ensuring an optimum refrigerant recovery performance even with all cooling powers of the refrigerator.

The present disclosure further provides a refrigerator and a control method thereof capable of reducing unnecessary consumption of power, which is used when recovering the refrigerant.

The present disclosure further provides a refrigerator and a control method thereof capable of increasing an operation efficiency of a cooling system by optimally supplying the refrigerant to an evaporator under all operation conditions of the refrigerator.

The objects of the present disclosure are not limited to the above-mentioned objects and other objects and advantages of the present disclosure which are not mentioned may be understood by the following description and more clearly understood by the embodiments of the present disclosure.

Technical Solution

According to the present disclosure, a refrigerator and a control method thereof may enable accurately determining an end time point of a refrigerant recovery operation based on operation information of a compressor.

Specifically, according to the present disclosure, the refrigerator and the control method thereof may enable simply and accurately determining the end time point of the refrigerant recovery operation based on a change value of a driving input value applied to the compressor.

In addition, according to the present disclosure, the refrigerator and the control method thereof may enable determining the end time point of the refrigerant recovery operation without attaching a temperature sensor to an evaporator.

In addition, according to the present disclosure, the refrigerator and the control method thereof may enable detecting an operation state of the compressor and terminating the refrigerant recovery operation when an abnormal operation occurs in the compressor.

In addition, according to an embodiment of the present disclosure, there is provided a method for controlling a refrigerator, the refrigerator including a refrigerating room evaporator, a freezing room evaporator, a reciprocating compressor configured to supply refrigerant to each of the refrigerating room evaporator and the freezing room evaporator and use the refrigerant as a lubricant for a piston, and a refrigerant control valve configured to control the refrigerant flowing from the compressor to each of the refrigerating room evaporator and the freezing room evaporator. The method including: determining whether a condition of a refrigerant recovery operation is satisfied, wherein the refrigerant recovery operation is an operation for recovering the refrigerant from at least one of the refrigerating room evaporator or the freezing room evaporator; based on the condition of the refrigerant recovery operation being satisfied, performing the refrigerant recovery operation and detecting a driving input value applied to the compressor; comparing a first driving input value of the compressor with a second driving input value of the compressor in real time, wherein the first driving input value is a driving input at a first time point corresponding to a start time point of the refrigerant recovery operation and the second driving input value is a driving input value at a time point of the refrigerant recovery operation after the first time point; and determining a second time point of the refrigerant recovery operation at which a ratio of the first driving input value and the second driving input value is lower than a preset ratio as an end time point of the refrigerant recovery operation.

In addition, according to an embodiment of the present disclosure, a refrigerator includes a compressor configured to compress refrigerant; a condenser configured to condense the refrigerant compressed by the compressor; a refrigerating room expansion valve and a freezing room expansion valve configured to decompress the refrigerant condensed by the compressor and expand the refrigerant, a refrigerating room evaporator and a freezing room evaporator configured to evaporate the refrigerant expanded by the refrigerating room expansion valve and the freezing room expansion valve and generate cold air; a refrigerant control valve configured to adjust the refrigerant flowing from the condenser toward each of the refrigerating room evaporator and the freezing room evaporator; a controller configured to control the compressor and the refrigerant control valve. The controller is configured to: perform the refrigerant recovery operation and detect a driving input value applied to the compressor based on the condition of the refrigerant recovery operation being satisfied; compare a first driving input value of the compressor with a second driving input value of the compressor in real time, wherein the first driving input value is a driving input at a first time point corresponding to a start time point of the refrigerant recovery operation and the second driving input value is a driving input value at a time point of the refrigerant recovery operation after the first time point; and determine a second time point of the refrigerant recovery operation at which a ratio between the first driving input value and the second driving input value is lower than a preset ratio as an end time point of the refrigerant recovery operation.

Advantageous Effects

According to the present disclosure, it is possible to internally protect a refrigerator by accurately determining an end time point of a refrigerant recovery operation. Specifically, when the refrigerant recovery operation is performed for a fixed time period using refrigerant gas as a lubricant for a piston, the refrigerant recovery operation may be terminated when refrigerant gas is not sufficiently returned to a compressor according to the operation condition of the refrigerator. That is, when a sufficient amount of refrigerant gas that may be used as the lubricant for the piston does not present in the compressor, abrasion of the piston may occur. In order to address the above problems, the refrigerator according to the present disclosure detects a driving input value or a driving power value input to drive the compressor to check whether the sufficient amount of refrigerant gas has been introduced into the compressor, and when the refrigerant gas is sufficiently recovered, the refrigerator determines a time point at which the driving input value of the compressor is reduced and terminates the refrigerant recovery operation. In addition, the refrigerator according to the present disclosure accurately determines the end time point of the refrigerant recovery operation, thereby preventing unnecessary driving of the compressor and reducing unnecessary power consumption.

According to the present disclosure, the refrigerator may accurately determine the end time point of the refrigerant recovery operation without attaching temperature sensors to a discharge end and a suction end of the compressor. Therefore, manufacturing cost of the refrigerator may be reduced.

In addition, according to the present disclosure, when an abnormal operation occurs in the compressor, the refrigerant may be internally protected by terminating the refrigerant recovery operation.

In addition, according to the present disclosure, operating efficiency of the refrigerator may be increased by optimally supplying the refrigerant to the evaporator under all operation conditions of the refrigerator.

Further to the effects described above, specific effects of the present disclosure are described together while describing detailed matters for implementing the present disclosure.

DESCRIPTION OF DRAWINGS

FIG. 1 is a front view showing an interior of a refrigerator according to an embodiment of the present disclosure.

FIG. 2 is a perspective view showing devices of the refrigerator of FIG. 1.

FIG. 3 is a control block diagram of a refrigerator according to an embodiment of the present disclosure.

FIG. 4 shows a structure of a compressor according to an embodiment of the present disclosure.

FIG. 5 shows relation between an operation and a force of the compressor of FIG. 4.

FIG. 6 shows a schematic configuration of an operation control device of a compressor according to an embodiment of the present disclosure.

FIG. 7 shows a schematic configuration of an operation control device of a compressor according to another embodiment of the present disclosure.

FIGS. 8 to 10 show a flow of refrigerant during a cooling operation of a refrigerator according to an embodiment of the present disclosure.

FIG. 11 is a line diagram showing a method for controlling an operation of a refrigerator according to an embodiment of the present disclosure.

FIG. 12 is a graph showing relation between a driving power applied to a compressor during a refrigerant recovery operation and a difference between a discharge pressure and a suction pressure of the compressor.

FIG. 14 shows an example of operation information of a compressor in refrigerator according to an embodiment of the present disclosure.

MODE FOR INVENTION

Figure 13:
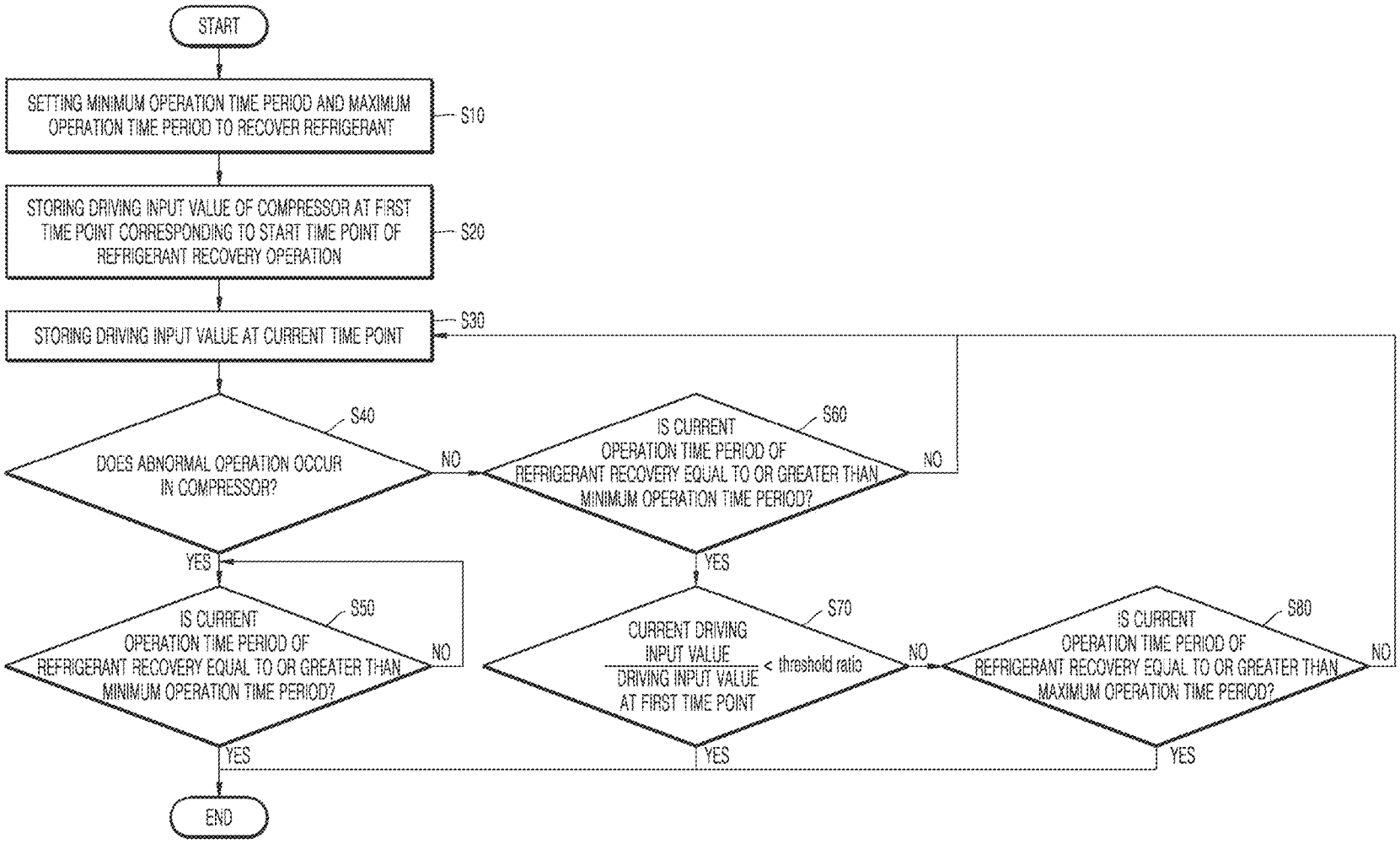
FIG. 13 is a flowchart of a method for controlling a refrigerator according to an embodiment of the present disclosure.

The above-mentioned objects, features, and advantages of the present disclosure are described in detail with reference to accompanying drawings. A person having ordinary knowledge in the art to which the present disclosure pertains may easily embody the technical idea of the present disclosure. A detailed description of a well-known technology relating to the present disclosure may be omitted if it unnecessarily obscures the gist of the present disclosure.

Hereinafter, preferred embodiments according to the present disclosure are described in detail with reference to the accompanying drawings. In the drawings, same reference numerals can be used to refer to same or similar components.

FIG. 1 is a front view showing an interior of a refrigerator according to an embodiment of the present disclosure.

Referring to FIG. 1, the refrigerator according to an embodiment of the present disclosure includes a main body 40 having a freezing room 31 and a refrigerating room 32, and doors 35L and 35R connected to the main body 40 by a hinge to open and close the freezing room 31 and the refrigerating room 32.

The freezing room 31 and the refrigerating room 32 are separated by a partition wall disposed in the main body 40 to prevent cold air flow and a freezing room evaporator and a refrigerating room evaporator are disposed in the freezing room 31 and the refrigerating room 32 to cool spaces thereof.

FIG. 2 is a perspective view showing devices of the refrigerator of FIG. 1.

As shown in FIG. 2, the refrigerator according to an embodiment of the present disclosure includes a compressor 100, a condenser 110 to condense refrigerant compressed by the compressor 100, a freezing room evaporator 124 disposed in the freezing room 31 to receive the refrigerant condensed by the condenser 110 and evaporate the refrigerant, a refrigerating room evaporator 122 disposed in a refrigerating room 32 to receive the refrigerant condensed by the condenser 110 and evaporate the refrigerant, a 3 way valve 130 which is a refrigerant control valve to supply the refrigerant condensed by the condenser 110 to the refrigerating room evaporator 122 or the freezing room evaporator 124, a refrigerating room expansion valve 132 to expand the refrigerant supplied to the refrigerating room evaporator 122, and a freezing room evaporator 124.

A refrigerating room fan 142 is disposed in the refrigerating room 32 to improve heat exchange efficiency of the refrigerating room evaporator 122 and circulate air inside of the refrigerating room 32. In addition, a freezing room fan 144 is disposed in the freezing room 31 to improve heat exchange efficiency of the freezing room evaporator 124 and circulate the air inside of the freezing room 31.

In addition, a check valve is disposed at a discharge side of the refrigerating room evaporator 122 to prevent flow of the refrigerant from the freezing room evaporator 124.

In short, the refrigerator shown in FIGS. 1 and 2 has a 1COM-2EVA system in which the refrigerating room 32 and the freezing room 31 are independently cooled by respective evaporators 122 and 124.

The 3 way valve 130 may select and open and close a flow path of the refrigerant supplied from the condenser 110, and may open or close either the refrigerating room expansion valve 132 or the freezing room expansion valve 134.

Meanwhile, in this embodiment, the 3 way valve 130 may be disposed, but instead of the 3 way valve 130, an opening/closing valve may be disposed in each of pipes connected to the refrigerating room evaporator 122 and the freezing room evaporator 124.

Meanwhile, the refrigerator may include an outside air temperature sensor to sense an outside air temperature, a refrigerating room temperature sensor to sense a temperature of the refrigerating room, and a freezing room temperature sensor to detect the temperature of the freezing room.

The outside air temperature sensor detects the outside temperature of the refrigerating room 32 and the freezing room 31. The outside air temperature sensor may detect the temperature of outside air (i.e., outside air) suctioned into a machine room. The refrigerating room temperature sensor is disposed inside of the refrigerating room 32 to detect the temperature inside of the refrigerating room 32. The freezing room temperature sensor is disposed inside of the freezing room 31 to detect the temperature inside of the freezing room 31.

FIG. 3 is a control block diagram of a refrigerator according to an embodiment of the present disclosure.

Referring to FIG. 3, the refrigerator may further include an input unit 150 to input a desired refrigerating room temperature or a desired freezing room temperature. The input unit 150 may be disposed in a main body 40, and a user may input the desired refrigerating room temperature or the desired freezing room temperature by manipulating the input unit 150. When an additional operation is not performed using the input unit 150, the refrigerator may be operated based on a desired refrigerating room temperature or a desired freezing room temperature set at a time of manufacturing thereof.

The refrigerator may further include a condensing fan 160. The condensing fan 160 is disposed adjacent to the condenser 110 and may blow outside air from the main body 40 to the condenser 110.

The refrigerator may further include a controller 180 to control a compressor 100, a 3 way valve 130, a condensing fan 160, a refrigerating room fan 142, and a freezing room fan 144. The controller 180 may be a processor-based device. The processor may include one or more of a central processing unit, an application processor, or a communication processor.

Meanwhile, the controller 180 may include a main controller and a compressor controller. The compressor controller and the main controller may each transmit and receive various pieces of information through bidirectional communication.

The controller 180 may determine the refrigerating room temperature satisfaction/dissatisfaction based on the temperature detected by the refrigerating room temperature sensor 172. If the temperature detected by the refrigerating room temperature sensor 172 is within a refrigerating room temperature satisfaction range, the controller 180 may determine a state of temperature detected by the refrigerating room temperature sensor 172 as a refrigerating room temperature satisfaction state. If the temperature detected by the refrigerating room temperature sensor 172 is within a refrigerating room temperature dissatisfaction range, the controller 180 may determine a state of the temperature detected by the refrigerating room temperature sensor 172 as a refrigerating room temperature dissatisfaction state. The refrigerating room temperature satisfaction range may be set lower than the refrigerating room temperature dissatisfaction range. The refrigerating room temperature satisfaction range and the refrigerating room temperature dissatisfaction range may be set based on a refrigerating room reference temperature set at the time of manufacturing of the refrigerator or a desired refrigerating room temperature input by a user. The controller 180 may control the compressor 100, the 3 way valve 130, the condensing fan 160, and the refrigerating room fan 142 to adjust the refrigerating room temperature to be within the refrigerating room temperature satisfaction range and this operation may be a refrigerating room operation.

The controller 180 may determine the freezing room temperature satisfaction/dissatisfaction based on the temperature detected by freezing room temperature sensor 173. If the temperature detected by freezing room temperature sensor 173 is within the freezing room temperature satisfaction range, the controller 180 may determine a state of the temperature detected by freezing room temperature sensor 173 as a freezing room temperature satisfaction state. If the temperature detected by freezing room temperature sensor 173 is within the freezing room temperature dissatisfaction range, the controller 180 may determine a state of the temperature detected by freezing room temperature sensor 173 as the freezing room temperature dissatisfaction state. The freezing room temperature satisfaction range may be set lower than the freezing room temperature dissatisfaction range. The freezing room temperature satisfaction range and the freezing room temperature dissatisfaction range may be set based on a freezing room reference temperature set at the time of manufacturing of the refrigerator or a desired freezing room temperature input by the user. The controller 180 may control the compressor 100, the 3 way valve 130, the condensing fan 160, and the freezing room fan 144 to adjust the freezing room temperature to be within the freezing room temperature satisfaction range and the operation may be a freezing room operation.

The controller 180 may drive the compressor 100, control the 3 way valve 130 to be in refrigerating room cooling mode, and drive the condensing fan 160 and the refrigerating room fan 142 when the refrigerating room temperature is within the dissatisfaction range in a state in which the compressor 100 is stopped or the refrigerator is in an initial operation state in which power is applied to the refrigerator.

When the compressor 100 is driven, the 3 way valve 130 is in the refrigerating room cooling mode, and the condensing fan 160 and the refrigerating room fan 142 are driven, the refrigerant may circulate through the compressor 100, the condenser 110, the refrigerating room expansion valve 132, and the refrigerating room evaporator 122, the refrigerating room fan 142 may circulate cold air of the refrigerating room 32 to the refrigerating room evaporator 122 and the refrigerating room 32, and the refrigerator may perform a refrigerating room operation to cool the refrigerating room 32.

When the refrigerating room temperature detected by the refrigerating room temperature sensor 172 reaches the refrigerating room temperature satisfaction range, the controller 180 may stop the refrigerating room fan 142 and complete the refrigerating room operation.

When the refrigerating room operation is completed, the controller 180 may perform a freezing room operation, control the 3 way valve 130 in a freezing room cooling mode, and drive the freezing room fan 82. The compressor 100 and the condensing fan 160 may be driven in the freezing room cooling mode of the 3 way valve 130.

When the compressor 100 is driven, the 3 way valve 130 is in the freezing room cooling mode, and the condensing fan 160 and the freezing room fan 144 are driven, the refrigerant may circulate through the compressor 100, the condenser 110, the freezing room expansion valve 134, and the freezing room evaporator 124 and the freezing room fan 144 may circulate the cold air of the freezing room 31 to the freezing room evaporator 124 and the freezing room 31 and the refrigerator may perform the freezing room operation to cool the freezing room 31.

When the freezing room temperature detected by freezing room temperature sensor 173 reaches the freezing room temperature satisfaction range, the controller 180 may stop the freezing room fan 144 and complete the freezing room operation.

When the freezing room operation is completed, the controller 180 may perform a refrigerant recovery operation and control the 3 way valve 130 to be in a refrigerant recovery mode. In the refrigerant recovery mode, the 3 way valve 130 may close an inlet or close both a first outlet and a second outlet. Therefore, in the refrigerant recovery mode, the refrigerant does not flow from the condenser 110 to each of the refrigerating room evaporator 122 and the freezing room evaporator 124, and the refrigerant in the refrigerating room evaporator 122 and the remaining refrigerant in the freezing room evaporator 124 may be suctioned into the compressor 100 based on the driving of the compressor 100 and may be moved to the compressor 100.

When a refrigerant recovery operation termination condition is satisfied after the refrigerant recovery operation is performed, the controller 180 may terminate the refrigerant recovery operation. The conditions for terminating the refrigerant recovery operation are described below in more detail.

After the refrigerant recovery operation is terminated, the controller 180 may determine whether to start the refrigerating room operation based on the temperature detected by the refrigerating room temperature sensor 172, and if the temperature detected by the refrigerating room temperature sensor 172 is in the refrigerating room temperature dissatisfaction range, the controller 180 may start the refrigerating room operation.

Meanwhile, embodiments of the present disclosure may be applied to a reciprocating compressor including a piston. The reciprocating compressor compresses refrigerant based on a reciprocating motion of the piston. Further, embodiments of the present disclosure may be applied to an oilless compressor using refrigerant as a lubricant for a piston. That is, embodiments of the present disclosure may be applied to an oilless reciprocating compressor.

Hereinafter, a structure of the above-described compressor is described in detail with reference to FIGS. 4 and 5.

FIG. 4 shows a structure of a compressor 100 according to an embodiment of the present disclosure.

Referring to FIG. 4, the compressor 100 may be a linear compressor, which is an example of reciprocating compressor.

The compressor 100 includes a cylinder 420 disposed inside of a shell 401, a piston 430 to linearly reciprocate within the cylinder 420, and a motor assembly 440 as a linear motor to provide a driving force to the piston 430. When the motor assembly 440 is driven, the piston 430 may reciprocate in an axial direction.

The compressor 100 further includes a suction muffler 450 coupled to the piston 430 and to reduce noise generated from refrigerant suctioned through a suction pipe 404. The refrigerant suctioned through the suction pipe 404 flows into the piston 430 through the suction muffler 450.

The suction muffler 450 includes a first muffler 451, a second muffler 452, and a third muffler 453 coupled to one another.

The first muffler 451 is disposed inside of the piston 430 and the second muffler 452 is coupled to a rear side of the first muffler 451. The third muffler 453 accommodates the second muffler 452 and may extend to the rear side of the first muffler 451. From the viewpoint of a flow direction of the refrigerant, the refrigerant suctioned through the suction pipe 404 may sequentially pass through the third muffler 453, the second muffler 452, and the first muffler 451.

The suction muffler 450 further includes a muffler filter 455. The muffler filter 455 may be disposed at a boundary surface where the first muffler 451 and the second muffler 452 are coupled to each other.

Meanwhile, the term "axial direction" may be understood as a reciprocating direction of the piston 430, that is, a transverse direction in FIG. 4. In the "axial direction", a direction toward a compression space (P) from the suction pipe 404, that is, a flowing direction of the refrigerant is referred to as "a forward direction" and the opposite direction thereof is referred to as "a rearward direction". When the piston 430 moves in the forward direction, the compression space (P) may be compressed. Meanwhile, "a radial direction" is a direction perpendicular to the reciprocating direction of the piston 430 and may be understood as a vertical direction of FIG. 4.

The piston 430 includes a substantially cylindrical piston body 431 and a piston flange 432 that extends from the piston body 431 in the radial direction. The piston body 431 may reciprocate inside the cylinder 420 and the piston flange 432 may reciprocate at an outside of the cylinder 420.

The cylinder 420 includes a cylinder body 421 that extends in the axial direction and a cylinder flange 422 disposed outside of a front portion of the cylinder body 421. In addition, the cylinder 420 accommodates at least a portion of the first muffler 451 and at least a portion of the piston body 431.

A gas inlet 426 to which at least a portion of the refrigerants discharged through a discharge valve 461 described below is introduced is defined in the cylinder body 421. The gas inlet 426 may penetrate a radial inner portion thereof from an outer circumferential surface of the cylinder body 421.

A filter assembly 500 is disposed in the gas inlet 426. The filter assembly 500 includes a filter member to filter foreign matters or oil contained in the refrigerant gas. In addition, a flow rate of the refrigerant passing through the filter member is adjusted using a nozzle disposed in the filter assembly 500. The filter member functions as a gas bearing between the piston 430 and the cylinder 420.

Further, the cylinder 420 includes the compression space (P) in which the refrigerant is compressed by the piston 430. In addition, a suction hole 433 for introducing refrigerant into the compression space (P) is defined at a front side of the piston body 431 and a suction valve 435 is disposed at a front side of the suction hole 433 to selectively open the suction hole 433.

In addition, a fastening hole 436*a* to which a predetermined fastening member 436 is coupled is defined at the front side of the piston body 431. The fastening member 436 is coupled to the fastening hole 436*a* through the suction valve 435 and couples the suction valve 435 to the front side of the piston body 431.

A discharge cover 460 including a discharge space 460*a* of the refrigerant discharged from the compression space (P) and discharge valve assemblies 461 and 463 coupled to the discharge cover 460 and to selectively discharge the refrigerant compressed in the compression space (P) are disposed in front of the compression space (P).

The discharge valve assemblies 461 and 463 include the discharge valve 461 that is opened when a pressure inside the compression space (P) is equal to or greater than a discharge pressure, and to introduce the refrigerant to the discharge space 460*a* of the discharge cover 460 and a spring assembly 463 disposed between the discharge valve 461 and the discharge cover 460 and to provide an elastic force in the axial direction. The spring assembly 463 includes a valve spring 463*a* and a spring supporter 463*b* to support the valve spring 463*a* on the discharge cover 460.

The discharge valve 461 is coupled to the valve spring 463*a* and a rear portion or a rear surface of the discharge valve 461 is supported on a front surface of the cylinder 420. When the discharge valve 461 is supported on the front surface of the cylinder 420, the compression space (P) remains closed, and when the discharge valve 461 is separated from the front surface of the cylinder 420, the compression space (P) is opened and the refrigerant compressed in the compression space (P) may be discharged. The compression space (P) is provided between the suction valve 435 and the discharge valve 461.

In the process of linear reciprocation of the piston 430 inside the cylinder 420, when a pressure in the compression space (P) is less than the discharge pressure and is equal to or less than the suction pressure, the suction valve 435 is opened to suction the refrigerant into the compression space (P). If the pressure in the pressure space (P) is equal to or greater than the suction pressure, the refrigerant in the compression space (P) is compressed when the suction valve 435 is closed.

In addition, when the pressure in the compression space (P) is equal to or greater than the discharge pressure, the valve spring 463*a* is deformed in the forward direction to open the discharge valve 461, and the refrigerant is discharged to the discharge space 460*a* from the compression space (P). After the refrigerant is discharged, the valve spring 463*a* provides a restoring force to the discharge valve 461 to close the discharge valve 461.

The compressor 100 further includes a frame 410. The frame 410 fixes the cylinder 420. For example, the cylinder 420 may be press-fit into the frame 410.

The frame 410 includes a frame body 411 having a substantially cylindrical shape and a frame flange 412 that extends from the frame body 411 in the radial direction. The frame body 411 surrounds the cylinder 420. That is, the cylinder 420 may be accommodated inside the frame body 411. In addition, the frame flange 412 may be coupled to the discharge cover 460.

The motor assembly 440 includes an outer stator 441, an inner stator 448 spaced apart from the outer stator 441 in an inward direction of the outer stator 441, and a magnet 446 disposed in a space between the outer stator 441 and the inner stator 448.

The magnet 446 may linearly reciprocate by an electromagnetic force between the outer stator 441 and the inner stator 448. The inner stator 448 is coupled to an outer circumference of the frame body 411. The outer stator 441 includes coil winding bodies 441*b*, 441*c*, and 441*d* and a stator core 441*a*. The coil winding bodies 441*b*, 441*c*, and 441*d* include a bobbin 441*b* and a coil 441*c* wound in a circumferential direction of the bobbin.

In addition, the compressor 100 further includes a plurality of resonance springs 476*a* and 476*b* having natural frequencies adjusted to resonate the piston 430. The driver reciprocating in the compressor 100 may be stably moved based on operations of the plurality of resonance springs 476*a* and 476*b* and vibration or noise occurring based on the movement of the driver may be reduced.

In short, the compressor 100 described with reference to FIG. 4 includes the compression space to which working gas is suctioned and discharged between the piston 430 and the cylinder 420, and the piston 430 linearly reciprocates inside of the cylinder and compresses the refrigerant.

FIG. 5 shows relation between an operation and a force of the compressor 100 of FIG. 4. In this case, m is a mass of a piston 430, $k_m$ is an elastic modulus of springs 476*a* and 476*b*, A is a cross-sectional area of a bore, $\alpha i$ is a constant related to a counter electromotive force of the compressor 100, i is a current applied to the compressor 100, and $C_f$ is attenuation coefficient of the compressor 100.

FIG. 6 shows a schematic configuration of an operation control device of a compressor 100 according to an embodiment of the present disclosure.

Referring to FIG. 6, the operation control device of the compressor 100 includes a reciprocating compressor (L.COMP) to change stroke based on a vertical motion of a piston 430 by a voltage applied to a motor (M) according to a stroke command value and adjust a cooling power, a current detector 620 and a voltage detector 630 to detect a current and a voltage generated in the reciprocating compressor (L.COMP) as the stroke is increased by the applied voltage, a microcomputer 640 to calculate a stroke based on the voltage and the current detected by the current detector 620 and the voltage detector 630, compare the stroke with the stroke command value, and output a switching control signal, and an electric circuit 610 to shut off alternating power using Triac (Tr1) based on the switching control signal output from the microcomputer 640 and apply the voltage to the reciprocating compressor (L.COMP).

The reciprocating compressor (L.COMP) vertically moves the piston 430 by the applied voltage according to the stroke command value set by the user, changes the stroke, and adjusts the cooling power.

The stroke is increased as a turn-on period of the Triac (Tr1) of an electric circuit 610 is lengthened based on the switching control signal of the microcomputer 640. In this case, the current detector 620 and the voltage detector 630 detect the current and the voltage applied to the motor (M) of the reciprocating compressor (L. COMP) and apply the current and the voltage to the microcomputer 640.

The microcomputer 640 calculates the stroke based on the applied current and voltage detected by the current detector 620 and the voltage detector 630, and then compares the stroke with the stroke command value to output a switching control signal.

That is, when the calculated stroke is less than the stroke command value, the microcomputer 640 outputs the switching control signal to lengthen the turn-on period of the Triac (Tr1) and increases a voltage applied to the reciprocating compressor (L.COMP). Further, when the calculated stroke is greater than the stroke command value, the microcomputer 640 outputs a switching control signal to shorten the turn-on period of the Triac (Tr1) to reduce the voltage applied to the reciprocating compressor (L.COMP).

FIG. 7 shows a schematic configuration of an operation control device of a compressor 100 according to another embodiment of the present disclosure.

Referring to FIG. 7, the operation control device of the compressor 100 is a stroke control device of a reciprocating compressor and includes a current detector 710, a stroke detector 711, a phase difference detector 720, a comparator 730, a stable area storage portion 740, an operation frequency determiner 750, a stroke command value determiner 760, a frequency/stroke storage portion 770, a controller 780, and an inverter 790.

The current detector 710 detects a current flowing through a motor. The stroke detector 711 detects a current stroke of a piston based on a voltage and a current applied to the motor. The phase difference detector 720 receives the piston stroke detected by the stroke detector 711 and a motor current detected by the current detector 710 to detect a phase difference. The stable area storage portion 740 detects and stores a phase difference stable area to perform a stable operation. The comparator 730 compares whether the phase difference detected by the phase difference detector 720 is included in the phase difference stable area. The operation frequency determiner 750 increases or decreases a reference operation frequency by a predetermined frequency unit, and when the phase difference between the current and the piston stroke is in the stable area, the operation frequency determiner 750 determines a frequency at that time point as the operation frequency based on a comparison signal of the comparator 730. The stroke command value determiner 760 determines a stroke command value based on the operation frequency output from the operation frequency determiner 750. The frequency/stroke storage portion 770 stores a piston stroke for each operation frequency. The controller 780 compares the stroke command value with the current stroke of the piston and outputs a stroke control signal based on the comparison. The inverter 790 changes a voltage applied to the motor by varying the operation frequency based on the stroke control signal output from the controller 780.

In more detail, the stroke control device of the compressor detects an inflection point of the phase difference between the piston stroke and the current, and varies the operation frequency to drive the motor in the stable area. That is, the current detector 710 detects a current applied to the motor, applies the current to the phase difference detector 200, and the stroke detector 711 detects a piston stroke based on the voltage and current applied to the motor.

The phase difference detector 720 detects a phase difference between the power supply voltage and the motor current, a phase difference between the motor current and the motor voltage, a phase difference between the motor speed and the motor current, or a phase difference between a motor acceleration and the motor current and controls the motor to be driven in the stable area.

The stable area storage portion 740 detects and stores an area having a value less than ±δ (a predetermined value) based on the phase difference between the motor current and the piston stroke, the motor current and the piston speed, the motor current and the piston acceleration, or the motor current and the motor voltage when mechanical resonance occurs.

The comparator 730 receives the phase difference between the piston stroke and the current detected by the phase difference detector 720, compares whether the phase difference is included in the safety area of the stable area storage portion 740, and applies a comparison signal to the operation frequency determiner 750.

The operation frequency determiner 750 increases or decreases the reference operation frequency by a predetermined frequency unit, and when the phase difference between the current and the piston stroke is included in the stable area, the operation frequency determiner 750 determines a frequency at that time point as the operation frequency based on the comparison signal of the comparator 730 and applies it to the stroke command value determiner 760.

The stroke command value determiner 760 determines a stroke command value based on the operation frequency output from the operation frequency determiner 750.

That is, the frequency/stroke storage portion 770 to store the piston stroke for each frequency reads the piston stroke corresponding to the operation frequency output from the operation frequency determiner 750 and determines the piston stoke as a stroke command value.

The controller 780 receives the stroke command value output from the stroke command value determiner 760, compares the stroke command value with the piston stroke of the stroke detector 711, and outputs a stroke control signal. That is, the comparator 712 compares the stroke command value with the piston stroke, outputs a difference value and the stroke controller 713 applies the corrected stroke control signal to the inverter 790 based on the difference value.

The inverter 790 changes the voltage applied to the motor by varying the operation frequency based on the stroke control signal output from the controller 780.

Hereinafter, a method for controlling a refrigerator is described in detail with reference to the above matters.

FIGS. 8 to 10 show a flow of refrigerant during a cooling operation of a refrigerator according to an embodiment of the present disclosure.

Referring to FIGS. 8 to 10, a 3 way valve 130 includes an inlet 130*a* and two outlets 130*b* and 130*c*. The first outlet 130*b* among the two outlets 130*b* and 130*c* may be connected to a refrigerating room expansion tube 132 and the second outlet 130*c* among the two outlets 130*b* and 130*c* may be connected to a freezing room expansion tube 134.

Referring to FIG. 8, the 3 way valve 130 may be controlled in a first mode in which the inlet 130*a* communicates with the first outlet 130*b* and a space between the inlet 130*a* and the second outlet 130*c* is closed. The first mode corresponds to a mode in which refrigerant flows to a refrigerating room evaporator 122, that is, a refrigerating room cooling mode.

Referring to FIG. 9, a 3 way valve 130 may be controlled in a second mode in which an inlet 130*a* communicates with a second outlet 130*c* and a space between the inlet 130*a* and a first outlet 130*b* is closed. The second mode corresponds to a mode in which refrigerant flows to a freezing room evaporator 124, that is, a freezing room cooling mode.

Referring to FIG. 10, a 3 way valve 130 may be controlled in a third mode in which an inlet 130*a* is closed or a first outlet 130*b* and a second outlet 130*c* are closed. The third mode may be a mode in which refrigerant does not flow to a refrigerating room evaporator 122 and a freezing room evaporator 124, that is, a refrigerant recovery mode.

FIG. 11 is a line diagram of a method for controlling an operation of the refrigerator of FIGS. 8 to 10.

In FIG. 11, valve R is a flow path of a 3 way valve 130 at a refrigerating room side, valve F is a flow path of the 3 way valve 130 at a freezing room side, and opening and closing of the flow path at the refrigerating room side is referred to as "turn-on/turn-off of the valve R" and opening and closing of the flow path at the freezing room side is referred to as "on/off of the valve F".

Referring to FIG. 11, a refrigerating room operation, a freezing room operation, and a refrigerant recovery operation are sequentially performed.

During the operation of the refrigerating room, when a compressor 100 is operated, the valve R is turned on and the valve F is turned off. In this case, refrigerant flows from a condenser 110 to a refrigerating room expansion valve 132 and a refrigerating room evaporator 122, a condensing fan 160 and a refrigerating room fan 142 are driven, and a freezing room fan 144 is not driven.

Subsequently, during the operation of the freezing room, when the compressor 100 is driven, the valve F is turned on and the valve R is turned off. In this case, the refrigerant flows from the condenser 110 to a freezing room expansion valve 134 and a freezing room evaporator 124, the condensing fan 160 and a freezing room fan 144 are driven, and the refrigerating room fan 142 is not driven.

Subsequently, during the refrigerant recovery operation, while the compressor 100 is driving, both the valve R and the valve F are turned off. In this case, the refrigerant does not flow from the condenser to each of the refrigerating room evaporator 122 and the freezing room evaporator 124. That is, the refrigerant supply to the refrigerating room and freezing room evaporators 122 and 124 is blocked.

In addition, the driving of the freezing room fan 144 during the freezing room operation, which is a previous operation to the refrigerant recovery operation, is maintained. For example, the freezing room fan 144 is driven at a low speed.

The residual refrigerant inside of the freezing room evaporator 124 is evaporated by the operation of the freezing room fan 144, and a pressure inside of the freezing room evaporator 124 is increased by heat exchange. The refrigerant in the freezing room evaporator 124 flows toward the compressor 100.

In addition, as the refrigerating room evaporator 122 has not been driven until the refrigerant recovery operation, the pressure of the refrigerating room evaporator 122 is higher than that of the freezing room evaporator 124 without additionally driving the refrigerating room fan 142. Therefore, the residual refrigerant inside of the refrigerating room evaporator 122 is smoothly moved to the compressor 100 by driving the compressor 100.

In particular, during the cooling recovery operation, the freezing room fan 144 is driven when the driving of the condensing fan 160 is stopped. That is, if the condensing fan 160 is driven, internal pressure of the condenser 110 is increased, thereby causing an adverse effect when recovering the refrigerant, so the condensing fan 160 is not driven.

Meanwhile, the embodiment in which the refrigerant recovery operation is performed after the freezing room operation is described hereinabove, but the above configuration may be similarly performed even when the refrigerant recovery operation is performed after the refrigerating room operation. In addition, even when the refrigerating room operation and the freezing room operation are simultaneously performed, the above configuration may be similarly performed.

Hereinafter, a configuration of determining an end time point of the refrigerant recovery operation is described in more detail with reference to drawings below.

As described above, the compressor converts mechanical energy into compressive energy of compressible fluid. In particular, a reciprocating compressor includes a compression space between the piston and the cylinder to suction and discharge working gas, and the piston linearly reciprocates inside the cylinder to compress refrigerant.

In this case, the operation of the reciprocating compressor may be modeled as shown in FIG. 5 and Equation 1.

$$\text{Power} = \frac{F \times x}{t} \qquad \text{[Equation 1]}$$

$$F = \alpha i = m\frac{d^2x}{dt^2} + C_f\frac{dx}{dt} + K_m x + A(P_d - P_s)$$

Power is a driving input value (i.e., power or energy) applied to a compressor, F is a force of the compressor, x is a stroke of the piston of the compressor, t is time, $\alpha$ is a constant related to a counter electromotive force of the compressor, i is a current applied to the compressor, m is a mass of the piston of the compressor, $C_f$ is attenuation coefficient of the compressor, $K_m$ is an elastic modulus of the spring of the compressor, A is a cross-sectional area of a bore, Pa is the discharge pressure of a compressor, and $P_s$ is a suction pressure of the compressor.

Referring to Equation 1, when the stroke (x) of the piston is fixed as a constant, it can be seen that a driving power (Power) applied to the compressor is proportional to a difference ($\Delta P$) between the discharge pressure ($P_d$) and the suction pressure ($P_s$) of the compressor (Power $\propto \Delta P$).

The above relation is described in more detail as follows.

FIG. 12 is a graph showing relation between a driving power applied to a compressor during a refrigerant recovery operation and a difference ($\Delta P$) between a discharge pressure ($P_d$) and a suction pressure ($P_s$) of the compressor.

The upper graph of FIG. 12 is derived from a simulation of the refrigerant recovery operation performed by the present inventor. In the simulation, temperature sensors were placed at a suction end and a discharge end of the compressor to measure temperatures of the suction end and the discharge end of the compressor, and a driving current and a driving voltage applied to the compressor were measured. In addition, the simulation was performed when a stroke (x) of the compressor (a piston) was fixed. In this case, as the temperatures of the suction end and the discharge end of the compressor are proportional to pressures of the suction end and the discharge end of the compressor (refer to an ideal gas state equation), the lower graph of FIG. 12 is obtained by replacing the temperature with the pressure.

Referring to FIG. 12, a driving power (derived from a current and a voltage) applied to the compressor before and after a start of the refrigerant recovery operation, and the temperature/pressure at the suction end and the discharge end of the compressor have substantially constant values.

In addition, when the refrigerant recovery operation is terminated, an amount of refrigerant suctioned into the compressor is reduced. In this case, a difference in temperature/pressure between the suction end and the discharge end is decreased, and thus, the driving power applied to the compressor is decreased. For example, the temperature/the pressure of the suction end and the discharge end of the compressor converge to a value, and a difference in temperature/pressure between the suction end and the discharge end becomes "0. In addition, the compressor performs no-load operation.

In short, when the refrigerant recovery operation starts and the refrigerant remains inside of the evaporators, the difference in temperature/pressure between the suction end and the discharge end is almost unchanged. However, when the refrigerant is almost suctioned into the evaporators, the difference in temperature/pressure between the suction end and the discharge end decreases, the compressor smoothly performs no-load operation, and the driving power applied to the compressor decreases.

Therefore, according to an embodiment of the present disclosure, an end time point of the refrigerant recovery operation may be determined based on the driving power applied to the compressor 100 during the refrigerant recovery operation, that is, the driving input value.

FIG. 13 is a flowchart of a method for controlling a refrigerator according to an embodiment of the present disclosure.

As described above, the refrigerator performs a series of tasks to lower a temperature of an object to be cooled such as food and may include a compressor 100, an operation control device of the compressor 100, a condenser 110, a refrigerator expansion tube 132, a freezer expansion tube 134, a refrigerating room evaporator 122, a freezing room evaporator 124, a 3 way valve 130, and a main controller. In this case, the steps of FIG. 13 may be performed by a compressor controller of the operation control device of the compressor 100.

In addition, the method for controlling the refrigerator may be performed based on operation information of the compressor 100. An example of operation information of the compressor 100 is as shown in FIG. 14. In particular, the method for controlling the refrigerator may be performed based on a driving input value or a driving power value of the compressor 100.

Meanwhile, before a start step of FIG. 13, whether a condition of a refrigerant recovery operation of recovering the refrigerant by the refrigerating room evaporator 122 and the freezing room evaporator 124 is satisfied may be determined.

For example, the condition of the refrigerant recovery operation may correspond to a condition in which a temperature of each of a freezing room 31 and a refrigerating room 32 satisfies a target temperature range of each of the freezing room and the refrigerating room after cooling the freezing room 31. That is, in general, a pressure and a temperature of the refrigerating room evaporator 122 are higher than those of the freezing room evaporator 124, and the refrigerant recovery operation may be performed after a second cooling operation when a first cooling operation by the refrigerating room evaporator 122 and the second cooling operation by the freezing room evaporator 124 are sequentially performed.

When the conditions of the refrigerant recovery operation are satisfied, it is assumed that the refrigerant recovery operation is started. In addition, it is assumed that a current detector and a voltage detector detect a driving current and a driving voltage applied to the compressor 100 in real time during a preset period of time and transmit them to a compressor controller, and the compressor controller detects a driving power applied to the compressor 100 based on the driving current and the driving voltage.

Hereinafter, the operation of the refrigerator performing the refrigerant recovery operation is described in more detail with reference to FIG. 13.

At S10, a minimum operation time period and a maximum operation time period of refrigerant recovery are set.

The minimum operation time period of the refrigerant recovery (i.e., the minimum refrigerant recovery operation time period) refers to a time period for which the compressor 100 performs the refrigerant recovery operation at a minimum degree. In addition, the maximum operation time period of the refrigerant recovery (that is, the maximum refrigerant recovery operation time period) refers to a time period for which the compressor 100 performs the refrigerant recovery operation at a maximum degree.

In particular, it is possible to prevent abrasion of the piston 430 of the compressor 100 using the refrigerant as a lubricant by setting the minimum refrigerant recovery operation time period.

In more detail, the compressor 100 according to the present disclosure is an oilless compressor to lubricate between the piston 430 and the cylinder 420 using refrigerant gas. The refrigerant recovery operation may be terminated when the refrigerant is not sufficiently returned to the compressor 100 according to the operation condition of the refrigerator, and in this case, the lubrication may not be properly performed, thereby causing the abrasion of the piston 430. In the present disclosure, a minimum refrigerant recovery operation time period determined as a minimum value of the operation time period of the compressor 100 may be set to ensure that a sufficient amount of refrigerant flows into the compressor 100. In this case, the minimum refrigerant recovery operation time period may be set based on the operation state of the compressor (i.e., the driving input value).

Meanwhile, the minimum refrigerant recovery operation time period and the maximum refrigerant recovery operation time period may be set before the refrigerant recovery operation. In this case, S10 may be omitted.

At S20, a driving input value of the compressor 100 detected at a first time point corresponding to a start time point (a beginning time point) of the refrigerant recovery operation is stored.

In this case, the first time point may be a start time point of the refrigerant recovery operation or may be a time point closer to the start time point of the refrigerant recovery operation. In addition, the driving input value may correspond to a driving power value applied to the compressor 100. The driving input value (i.e., the first driving input value) at the first time point may be stored in a memory of the compressor controller.

At S30, a driving input value of the compressor 100 detected at a current time point of the refrigerant recovery operation is stored. The driving input value (i.e., a second driving input value) of the compressor 100 at the current time point may also be stored in the memory of the compressor controller.

At S40, the compressor controller determines whether abnormal operation has occurred in the compressor 100.

The abnormal operation is a predefined operation of the compressor 100 and is related to protection logic of the compressor. For example, the abnormal operation may include a trip state of current, a low load state of the compressor, and the like.

If the compressor controller determines that the abnormal operation has occurred in the compressor 100, the compressor controller determines whether a current operation time period of the refrigerant recovery is equal to or greater than a minimum operation time period at S50. Based on the current operation time period of the refrigerant recovery being less than the minimum operation time period, S50 is performed again, and based on the current operation time period of the refrigerant recovery being equal to or greater than the minimum operation time period, the refrigerant recovery operation is terminated.

That is, at S50, the compressor 100 is driven for a time period that is longer than the minimum operation time period even if the abnormal operation occurs in the compressor 100. That is, the S50 is performed to introduce certain amount or more of refrigerant into the compressor 100, thereby preventing the abrasion of the piston 430 due to lack of lubricant.

By contrast, based on determination that the abnormal operation does not occur in the compressor 100, the compressor controller determines whether the current operation time period of the refrigerant recovery is equal to or greater than the minimum operation time period at S60.

Based on the current refrigerant recovery operation time period being less than the minimum operation time period, the process returns back to S30. That is, based on the current operation time of the refrigerant recovery not reaching the minimum operation time period, the refrigerant recovery operation is maintained and the current driving input value is updated. Accordingly, as described above, the refrigerant recovery operation is performed for a minimum time period or longer and the abrasion of the piston 430 may be prevented.

In addition, based on the current operation time period of the refrigerant recovery being equal to or longer than the minimum operation time period, the compressor controller determines whether a first ratio, which is a ratio between the driving input value at the first time point and the driving input value at the current time point is equal to or less than a threshold ratio at S70. That is, at S70, an end time point of the refrigerant recovery operation is determined by comparing the driving input value at the first time point with the driving input value at the current time point.

The threshold ratio is the above-mentioned preset ratio and may be determined experimentally. For example, the threshold ratio may be "0.5".

Based on the first ratio being less than the threshold ratio, the compressor controller stops the driving of the compressor 100 and terminates the refrigerant recovery operation.

That is, the compressor controller determines the second time point of the refrigerant recovery operation at which the driving input value at the current time point is less than the driving input value at the first time point by the threshold value as the end time point of the refrigerant recovery operation. For example, the compressor controller may stop the driving of the compressor 100 and terminate the refrigerant recovery operation at the second time point when a ratio (a1/a2) between the driving power value (a1) at the first time point and the driving power value (a2) at the current time point is lower than the threshold ratio. In this case, the second time point may be an initial time point of the refrigerant recovery operation at which the first ratio is lower than the preset ratio.

As mentioned above, the driving power value detected based on the driving current and the driving voltage applied to the compressor 100 during the refrigerant recovery operation is closely related to the temperature/pressure of the suction end and the discharge end of the compressor 100. That is, when the refrigerant recovery operation starts and the refrigerant is almost suctioned into the refrigerating room evaporator 122 and the freezing room evaporator 124, a difference in temperature/pressure between the suction end and the discharge end is reduced and the driving power value applied to the compressor 100 is reduced.

During the refrigerant recovery operation, when the driving power value at the current time point (i.e., the driving input value) is greater than a value obtained by multiplying the driving power value at the first time point by the threshold ratio, the compressor controller determines that a large amount of refrigerant still remains inside the refrigerating room evaporator 122 and the freezing room evaporator 124 and does not terminate the refrigerant recovery operation. In addition, during the refrigerant recovery operation, when the driving power value at the current time point (that is, the driving input value) reaches a value obtained by multiplying the driving power value at the first time point by the threshold ratio, the compressor controller determines that the refrigerant is almost discharged from the inside of each of the refrigerating room evaporator 122 and the freezing room evaporator 124 and terminates the refrigerant recovery operation.

Based on the first ratio exceeding the threshold ratio, the compressor controller determines whether the current operation time period of refrigerant recovery is equal to or greater than a maximum operation time period at S80.

Based on the current operation time period of the refrigerant recovery being less than the maximum operation time period, the process returns back to S30. That is, based on the current operation time period of the refrigerant recovery not reaching the maximum operation time period, the refrigerant recovery operation is maintained and the current driving input value is updated.

In addition, based on the current operation time period of the refrigerant recovery being equal to or greater than the maximum operation time period, the refrigerant recovery operation is terminated.

Meanwhile, the method for controlling the refrigerator described with respect to FIG. 13 may be applied when the compressor 100 performs continuous operation and intermittent operation.

In short, the refrigerator according to an exemplary embodiment of the present disclosure may accurately determine the end time point of the refrigerant recovery operation based on the operation information of the compressor 100, particularly, the driving input value of the compressor 100. Specifically, the refrigerator according to an embodiment of the present disclosure may not perform the refrigerant recovery operation during a fixed operation time period, but may change the execution time period of the refrigerant recovery operation depending on the driving input value of the compressor 100. Therefore, the end time point of the refrigerant recovery operation of the refrigerator may be determined simply and accurately.

In particular, the refrigerator according to an embodiment of the present disclosure may accurately determine the end time point of the refrigerant recovery operation without attaching the temperature sensor to the discharge end and the suction end of the compressor 100. Therefore, manufacturing cost of the refrigerator may be reduced.

In addition, the refrigerator may be internally protected by accurately determining the end time point of the refrigerant recovery operation. Specifically, when the refrigerant recovery operation is performed for the fixed time period using the refrigerant gas as the lubricant for the piston, the refrigerant recovery operation may be terminated when the refrigerant gas is not sufficiently returned to the compressor according to the operation condition of the refrigerator. That is, when the sufficient amount of refrigerant gas that may be used as the lubricant for the piston is not present in the compressor, the abrasion of the piston may occur. In order to address the above problems, the refrigerator according to the present disclosure detects the driving input value or the driving power value input to drive the compressor to check whether sufficient amount of refrigerant gas has been introduced into the compressor, and when the refrigerant gas is sufficiently recovered, the refrigerant recovery operation is terminated by determining a time point at which the driving input value of the compressor is decreased. In addition, the refrigerator according to the present disclosure may accurately determine the end time point of the refrigerant recovery operation, thereby preventing unnecessary driving of the compressor and reducing unnecessary power consumption.

In addition, the refrigerator according to an embodiment of the present disclosure may ensure an optimum refrigerant recovery performance even with all cooling powers of the refrigerator and optimally supply the refrigerant to the evaporators 122 and 124 even under all operation conditions of the refrigerator, thereby increasing the operation efficiency of the refrigerator.

In addition, according to an embodiment of the present disclosure, the refrigerator may detect the operation state of the compressor 100, and when the abnormal operation occurs in the compressor 100, the refrigerator may terminate the refrigerant recovery operation and may be internally protected.

In addition, embodiments of the present disclosure may be implemented in the form of program instructions that may be executed via various computer means and may be recorded in a computer-readable medium. The computer-readable medium may include program instructions, data files, data structures, and the like alone or in combination.

As described above, the present disclosure has been described with reference to embodiments and drawings limiting specific matters such as specific components. However, these are provided to aid overall understanding of the present disclosure and the present disclosure is not limited to the above embodiments and various modifications and changes can be made from the above description by a person having ordinary knowledge in the art to which the present disclosure pertains. Therefore, the spirit of the present disclosure should not be limited to the above embodiments and claims described below and all configurations that are equivalent to the claims or equivalent variations thereof belong to the scope of the spirit of the present disclosure.

The invention claimed is:

1. A method for controlling a refrigerator, the refrigerator including a refrigerating room evaporator, a freezing room evaporator, a compressor configured to supply refrigerant to each of the refrigerating room evaporator and the freezing room evaporator and to use the refrigerant as a lubricant for a piston, and a refrigerant control valve configured to control flow of the refrigerant from the compressor to each of the refrigerating room evaporator and the freezing room evaporator, the method comprising:

determining whether a condition for performing a refrigerant recovery operation is satisfied, wherein the refrigerant recovery operation is an operation for causing the refrigerant in at least one of the refrigerating room evaporator or the freezing room evaporator to return to the compressor;

based on the condition of the refrigerant recovery operation being satisfied, performing the refrigerant recovery operation;

determining a first driving input value applied to the compressor at a first time point corresponding to a start time point of the refrigerant recovery operation;

determining a second driving input value applied to the compressor at a time point subsequent to the first time point during the refrigerant recovery operation;

determining a ratio of the second driving input value to the first driving input value; and terminating the refrigerant recovery operation based on the ratio of the second driving input value to the first driving input value being less than a preset ratio.

2. The method of claim 1, further comprising:

determining whether a minimum refrigerant recovery operation time period has elapsed from the start time point of the refrigerant recovery operation; and comparing the first driving input value to the second driving input value based on the minimum refrigerant recovery operation time period having elapsed from the start time point of the refrigerant recovery operation, wherein the minimum refrigerant recovery operation time period is defined as a minimum value of an operation time period of the compressor to reduce abrasion of the piston.

3. The method of claim 1, wherein each of the first and second driving input values corresponds to a driving power value applied to the compressor, and wherein the method further comprises:

detecting a driving voltage and a driving current that are applied to the compressor; and determining the driving power value based on the detected driving voltage and the detected driving current.

4. The method of claim 1, further comprising:

determining whether the ratio of the second driving input value to the first driving input value becomes less than the preset ratio before an elapse of a preset maximum refrigerant recovery operation time from the start time point of the refrigerant recovery operation; and based on determining that the ratio of the second driving input value to the first driving input value does not become less than the preset ratio before the elapse of the preset maximum refrigerant recovery operation time, terminating the refrigerant recovery operation at a time point corresponding to the preset maximum refrigerant recovery operation time.

5. The method of claim 1, wherein terminating the refrigerant recovery operation is performed at a first instance at which the ratio of the second driving input value to the first driving input value becomes less than the preset ratio during the refrigerant recovery operation.

6. The method of claim 1, further comprising:

comparing the first driving input value to the second driving input value;

determining whether a predetermined abnormal operation occurs in the compressor; and based on an occurrence of the predetermined abnormal operation, terminating the refrigerant recovery operation regardless of a result of comparing the first driving input value to the second driving input value.

7. The method of claim 1, further comprising:

comparing the first driving input value to the second driving input value; and storing, in a non-transitory memory, the first driving input value prior to comparing the first driving input value to the second driving input value.

8. The method of claim 1, wherein a time interval between the start time point and an end time point of the refrigerant recovery operation is changed based on the first driving input value and the second driving input value of the compressor.

9. The method of claim 1, further comprising:

performing a first cooling operation by the refrigerating room evaporator; and after performing the first cooling operation, performing a second cooling operation by the freezing room evaporator, wherein a pressure and a temperature of the refrigerating room evaporator are higher than a pressure and a temperature of the freezing room evaporator, respectively, and wherein the refrigerant recovery operation is performed after performing the second cooling operation.

10. The method of claim 1, wherein the refrigerant recovery operation comprises:

driving the compressor while the refrigerant control valve is closed to thereby cause the refrigerant in at least one of the refrigerating room evaporator or the freezing room evaporator to return to the compressor.

11. The method of claim 1, wherein the refrigerant recovery operation comprises performing a continuous operation or an intermittent operation of the compressor.

12. A refrigerator, comprising:

a compressor configured to compress refrigerant, the compressor comprising a piston;

a condenser configured to condense the refrigerant compressed by the compressor;

a refrigerating room expansion valve and a freezing room expansion valve that are configured to decompress the refrigerant condensed by the compressor and to expand the refrigerant;

a refrigerating room evaporator configured to evaporate the refrigerant expanded by the refrigerating room expansion valve to thereby generate cold air;

a freezing room evaporator configured to evaporate the refrigerant expanded by the freezing room expansion valve to thereby generate cold air;

a refrigerant control valve configured to adjust flow of the refrigerant from the condenser toward each of the refrigerating room evaporator and the freezing room evaporator; and a controller configured to control the compressor and the refrigerant control valve to thereby perform a refrigerant recovery operation for causing the refrigerant in at least one of the refrigerating room evaporator or the freezing room evaporator to return to the compressor, wherein the controller is configured to:

determine whether a condition for performing the refrigerant recovery operation is satisfied, based on the condition of the refrigerant recovery operation being satisfied, perform the refrigerant recovery operation, determine a first driving input value applied to the compressor at a first time point corresponding to a start time point of the refrigerant recovery operation, determine a second driving input value applied to the compressor at a time point subsequent to the first time point during the refrigerant recovery operation, determine a ratio of the second driving input value to the first driving input value, and terminate the refrigerant recovery operation based on the ratio of the second driving input value to the first driving input value being less than a preset ratio.

13. The refrigerator of claim 12, wherein the controller is configured to compare the first driving input value to the second driving input value after driving the compressor for a minimum refrigerant recovery operation time period, and wherein the minimum refrigerant recovery operation time period is defined as a minimum value of an operation time period of the compressor to reduce abrasion of the piston.

14. The refrigerator of claim 12, further comprising:

a voltage detector configured to detect a driving voltage applied to the compressor; and a current detector configured to detect a driving current applied to the compressor, wherein each of the first and second driving input values corresponds to a driving power value of the compressor, and wherein the controller is configured to determine the driving power value of the compressor based on the detected driving voltage and the detected driving current.

15. The refrigerator of claim 12, wherein the controller is configured to:

determine whether the ratio of the second driving input value to the first driving input value becomes less than the preset ratio before an elapse of a preset maximum refrigerant recovery operation time from the start time point of the refrigerant recovery operation; and based on determining that the ratio of the second driving input value to the first driving input value does not become less than the preset ratio before the elapse of the preset maximum refrigerant recovery operation time, terminate the refrigerant recovery operation at a time point corresponding to the preset maximum refrigerant recovery operation time.

16. The refrigerator of claim 12, wherein the controller is configured to perform the refrigerant recovery operation by driving the compressor while the refrigerant control valve is closed to thereby cause the refrigerant in at least one of the refrigerating room evaporator or the freezing room evaporator to return to the compressor.

17. The refrigerator of claim 12, wherein the controller is configured to terminate the refrigerant recovery operation at a first instance at which the ratio of the second driving input value to the first driving input value becomes less than the preset ratio during the refrigerant recovery operation.

18. The refrigerator of claim 12, wherein the controller is configured to:

compare the first driving input value to the second driving input value;

determine whether a predetermined abnormal operation occurs in the compressor; and based on an occurrence of the predetermined abnormal operation, terminate the refrigerant recovery operation regardless of a result of comparing the first driving input value to the second driving input value.

19. The refrigerator of claim 12, wherein the controller is configured to:

store the first driving input value in a non-transitory memory; and compare the first driving input value to the second driving input value after storing the first driving input value in the non-transitory memory.

20. The refrigerator of claim 12, wherein the controller is configured to:

perform a first cooling operation by the refrigerating room evaporator; and after performing the first cooling operation, perform a second cooling operation by the freezing room evaporator, wherein a pressure and a temperature of the refrigerating room evaporator are higher than a pressure and a temperature of the freezing room evaporator, respectively; and after performing the second cooling operation, perform the refrigerant recovery operation.

* * * * *